US006694619B1

(12) United States Patent
Steck et al.

(10) Patent No.: US 6,694,619 B1
(45) Date of Patent: Feb. 24, 2004

(54) DISPOSABLE FOOD CUTTING UTENSIL

(76) Inventors: John Edward Steck, 872 S. Milwaukee PMB264, Libertyville, IL (US) 60048; Robert Hamilton, 14 Sextant Dr., Grayslake, IL (US) 60030; James Martin, 784 Wortham Dr., Mundelein, IL (US) 60060

( * ) Notice: Subject to any disclaimer, the term of this patent is extended or adjusted under 35 U.S.C. 154(b) by 0 days.

(21) Appl. No.: 09/931,627

(22) Filed: Aug. 16, 2001

(51) Int. Cl.[7] ..... B26B 3/00; B65D 85/36

(52) U.S. Cl. ..... 30/142; 30/136; 206/525

(58) Field of Search ..... 30/115, 142, 301, 30/306, 307, 314, 319, 355, 327; 206/525, 551; D7/693, 673, 381

(56) References Cited

U.S. PATENT DOCUMENTS 4,877,609 A * 10/1989 Beck et al. ..... 206/525
4,890,549 A * 1/1990 Steiner et al. ..... 30/136
4,924,575 A * 5/1990 James ..... 30/315
D352,426 S * 11/1994 Tucker ..... D7/693
5,480,031 A * 1/1996 Maultasch et al. ..... 206/525
5,600,889 A * 2/1997 Marotta ..... 30/142
5,839,197 A * 11/1998 Durst ..... 30/353

* cited by examiner

*Primary Examiner*—Hwei-Siu Payer
(74) *Attorney, Agent, or Firm*—Michael Best & Friedrich LLP

(57) ABSTRACT

A disposable food cutting utensil, oval or circular in construction with an integrated handle area, packaging support legs and slots, and a removable marketing element. The utensil has a tapered and scalloped or serrated cutting edge that follows along a portion of the perimeter of the device, and allows for the inclusion of a handle area. Packaging support legs may be provided that protrude an arbitrary length from one side of the utensil, at sufficient distance from the cutting edge. Radial slots between the support legs permit the nesting of multiple utensils. The removable merchandising element is held in place by thin sections of material that are sufficient to secure the element in place, but permits its removal by hand. The merchandising element is of an arbitrary shape and sufficient size as to not present a choking hazard to small children.

2 Claims, 1 Drawing Sheet

DISPOSABLE FOOD CUTTING UTENSIL

FIELD OF THE INVENTION

This invention relates to a disposable food cutting utensil with additional functionalities. Additional functionalities of this invention include packaging support elements and a removable merchandising element.

BACKGROUND OF THE INVENTION

Disposable food cutting utensils are known in the art. Food packaging supports are known in the art. Removable merchandising elements are known in the art. The presented invention represents a novel disposable food cutting utensil. The presented invention also represents a significant enhancement of utility through combinations of known elements into a single device. A typical use of this invention would be to facilitate and promote the home delivery of food in large thin boxes suseptible to collapse that require cutting by the customer on arrival such as hot pizza, bread, pie, or cake. With the utensil disposable in nature, the inclusion of a removable merchandising element that can be detached prior to disposal provides a vehicle to promote repeat sales or additional business after the initial delivery. A typical use of this merchandising element would be to facilitate a per sale redemption program, promote a movie or television show, used as business identification refrigerator magnet, or used as a children's toy or game.

SUMMARY OF THE INVENTION

A disposable food cutting utensil, oval or circular in construction with an integrated handle area, packaging support legs and slots, and a removable marketing element. The cutting edge is tapered and scalloped or serrated. The cutting edge follows along the perimeter of the device, terminating at an arbitrary distance around to permit the inclusion of a handle area. Packaging support legs protrude an arbitrary length from one side of the utensil, at sufficient distance from the cutting edge. Radial slots between the support legs permit the nesting of multiple utensils. The removable merchandising element is held in place by thin sections of material sufficient to secure it in place, but fragile enough to permit removal by hand. The merchandising element is of an arbitrary shape and sufficient size as to not present a choking hazard to small children.

Other features and advantages of the presented invention will be apparent from the following detailed description, the accompanying drawings, and the appended claims.

DETAILED DESCRIPTION OF THE PREFERRED EMBODIMENT

Figure 1:
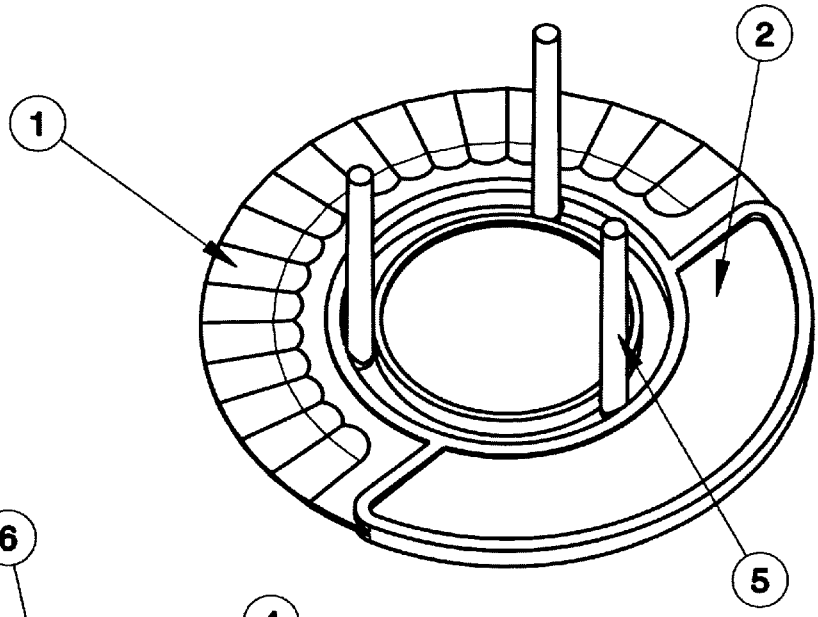
FIG. 1 is a perspective view of the bottom of the utensil.

While the presented invention is susceptible of embodiment in various forms, there is shown in the drawings and described hereafter a preferred embodiment to be considered an exemplification of the invention. This exemplification is not intended to limit the invention to the specific embodiment illustrated.

With respect to FIG. 1, the primary features of this utensil are represented by cutting edge (1) and handle area (2). The additional packaging support features of this utensil are partially represented by leg (5).

Figure 2:
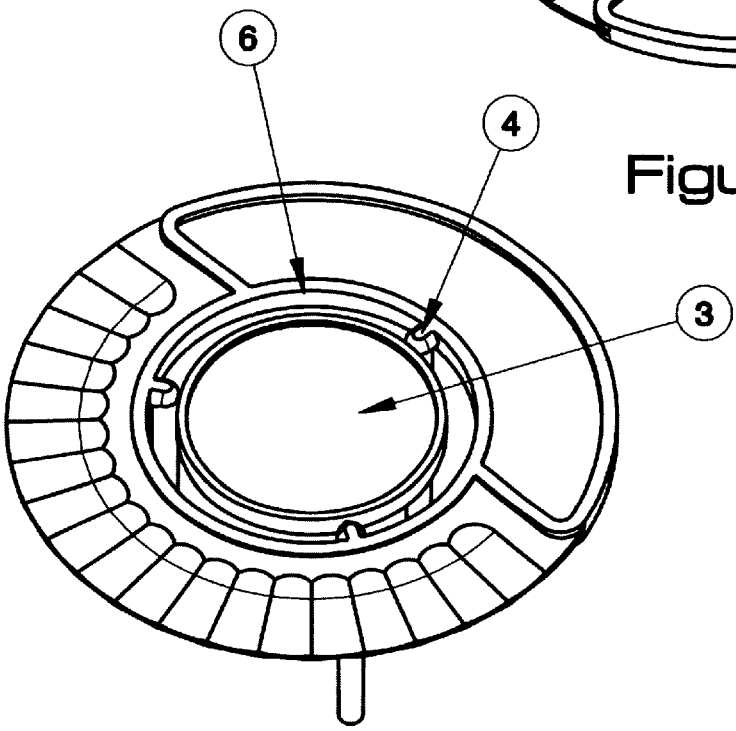
FIG. 2 is a perspective view of the top of the utensil.

With respect to FIG. 2, the additional merchandising element features of this utensil are represented by removable element (3) and attachment feature (4). The additional packaging support features of this utensil are partially represented by slot (6).

It will be observed that numerous modifications and variations can be implemented without departing from the true spirit and scope of the novel concepts of the presented invention. It is to be understood that no limitation with respect to the specific embodiments illustrated is intended or should be inferred. This disclosure is intended to cover by the claims all such modifications that fall within the scope of the claims.

What is claimed is:

1. A disposable, circular or oval shaped food cutting utensil comprising;

a tapered edge with scallops or serrations at a predetermined distance along the perimeter of the utensil;

an integrated handle area along the perimeter of the utensil;

integrated packaging elements further comprising;

support legs extending from one side of the utensil at a predetermined length;

said support legs at a predetermined distance from the perimeter of the tapered edge; and radial slots between the support legs to permit stacking of multiple utensils.

2. A food cutting utensil comprising;

a tapered edge with scallops or serrations at a predetermined distance along the perimeter of the utensil;

an integrated handle area along the perimeter of the utensil;

an integrated removable merchandising element having a shaped piece of predetermined size as not to constitute a choking hazard to small children; and an attachment of thin material for retaining the merchandising element and for permitting removal of the merchandising element from the cutting utensil.

* * * * *